US005505133A

United States Patent [19]

Chen

[11] Patent Number: 5,505,133

[45] Date of Patent: Apr. 9, 1996

[54] ROTARY STAMP

[76] Inventor: Chen Y.I. Chen, 4F, No. 48-50, Ta An Street, Shi Chih Town, Taipei Hsien, Taiwan

[21] Appl. No.: 294,276

[22] Filed: Aug. 22, 1994

[51] Int. Cl.[6] ..... B41F 13/10

[52] U.S. Cl. ..... 101/375; 101/368

[58] Field of Search ..... 101/375, 328–331, 101/405, 406, 377, 109, 110, 111, 368, 327

[56] References Cited

U.S. PATENT DOCUMENTS

| | | | |
|---|---|---|---|
| 1,964,455 | 6/1934 | Cook | 101/375 |
| 2,776,620 | 1/1957 | Quimby | 101/328 |
| 2,784,668 | 3/1957 | Poje | 101/109 |
| 3,146,707 | 9/1964 | Sloane | 101/329 |
| 3,927,613 | 12/1975 | Nantz | 101/110 |
| 4,040,350 | 8/1977 | Hopkins | 101/328 |
| 4,993,159 | 2/1991 | Hull et al. | 101/328 |

FOREIGN PATENT DOCUMENTS

| | | | |
|---|---|---|---|
| 2942831 | 5/1980 | Germany | 101/331 |

*Primary Examiner*—Edgar S. Burr
*Assistant Examiner*—Anthony H. Nguyen
*Attorney, Agent, or Firm*—Lowe, Price, LeBlanc & Becker

[57] ABSTRACT

A rotary stamp including a casing having an opening, an impression wheel revolvably mounted within the casing and partially projected out of the opening of the casing and having an annular groove around the periphery, and an ink-absorbed absorptive belt stamp mounted around the annular groove of the impression wheel a slip joint and turned by the impression wheel over something to mark it.

3 Claims, 4 Drawing Sheets

ROTARY STAMP

BACKGROUND OF THE INVENTION

The present invention relates to stamps, and relates more particularly to a rotary stamp for stamping marks on things by rolling an impression wheel.

FIG. 4 shows a rotary stamp according to the prior art which comprises a casing having an upright rod transversely disposed on the inside and an axle housing disposed below the upright rod, a cover board having a pin hole, which receives the upright rod of the casing, and an axle housing corresponding to the axle housing of the casing, an ink roller mounted around the upright rod of the casing, a stamping wheel peripherally covered with a ring-shaped stamp and having a center axle hole, a wheel axle inserted through the center axle hole and having two pin holes at two opposite ends, two locating blocks respectively received in the axle housings of the casing and the cover board and having each a horizontal rod respectively fitted into either pin hole of the wheel axle and a vertical rod supported on a respective spring inside either axle housing. The casing and the cover board are fastened together by fastening respective retainer rods on the casing into respective retaining holes on the cover board. When the ring-shaped stamp is turned over something to mark it, the springs on the locating blocks are compressed, causing the ring-shaped stamp contact the ink cylinder. This structure of rotary stamp consists of a lot of parts, therefore its assembly process is complicated and its manufacturing cost is high. Another drawback of this structure of rotary stamp is that the springs may fail to work properly after long uses, causing the ring-shaped stamp unable to contact the ink roller smoothly. When this problem occurs, the rotary stamp can no longer make a clear mark on things. Still another drawback of this structure of rotary stamp is that the ink cylinder is made from cotton cloth which absorbs less amount of ink and cannot evenly apply ink to the surface of the ring-shaped stamp. A yet further drawback of this structure of rotary stamp is that the retainer rods may be broken easily when they are fastened to or disconnected from the retaining holes on the cover board.

SUMMARY OF THE INVENTION

The present invention has been accomplished to provide a rotary stamp which eliminates the aforesaid drawbacks. It is therefore an object of the present invention to provide a rotary stamp which is simple in structure and easy to assemble. It is another object of the present invention to provide a rotary stamp which is inexpensive to manufacture. It is still another object of the present invention to provide a sponge ink roller uses an absorptive belt stamp, which absorbs ink before installation, mounted around the annular groove on an impression wheel so that when it is turned on an object by the impression wheel it marks the designed pattern on the object.

DETAILED DESCRIPTION OF THE PREFERRED EMBODIMENT

Figure 1:
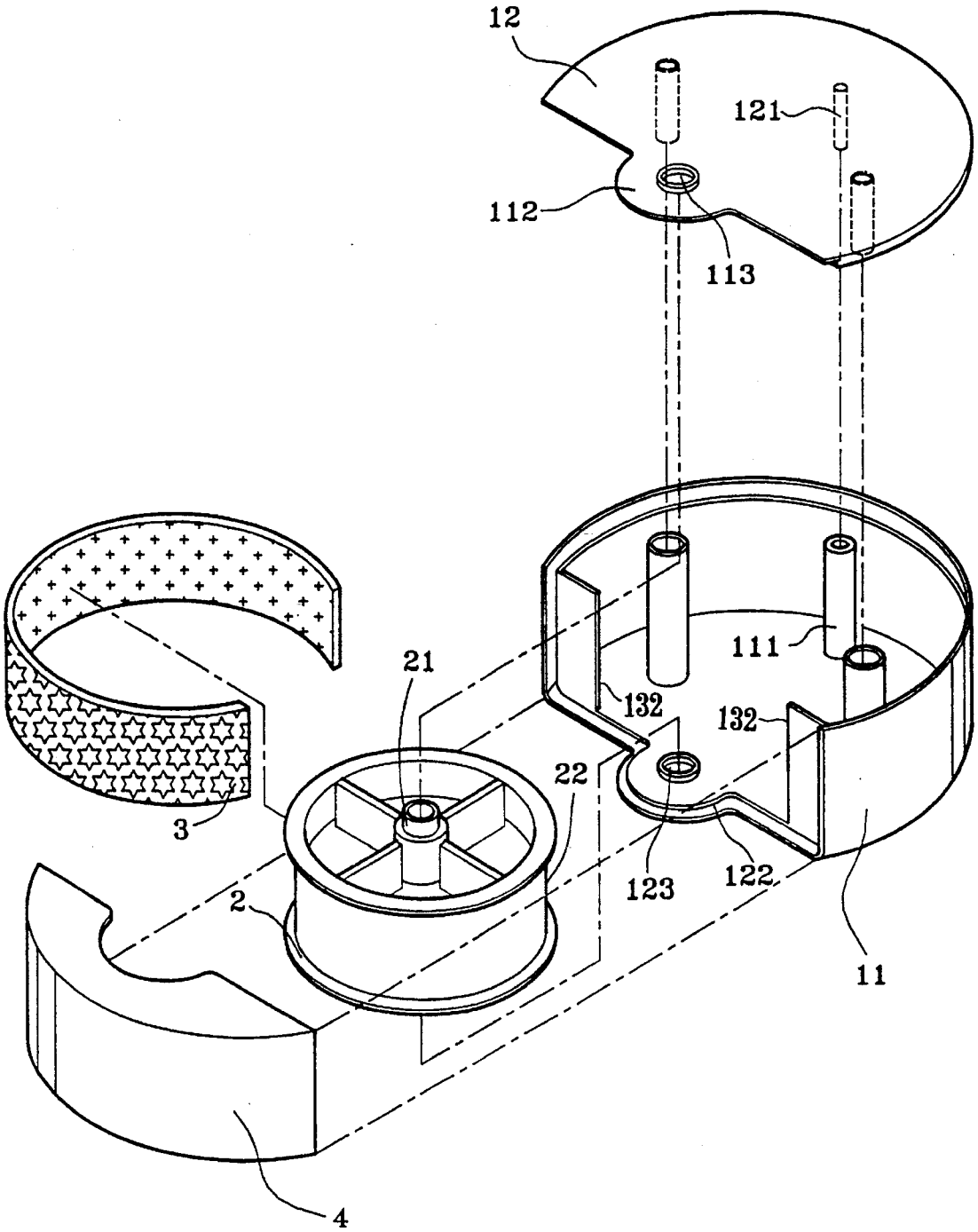
FIG. 1 is an exploded view of a rotary stamp according to the present invention.
Figure 2A:
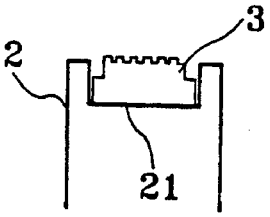
FIG. 2A is a cross-section fragmentary detailed view at "A" of FIG. 2.
Figure 2:
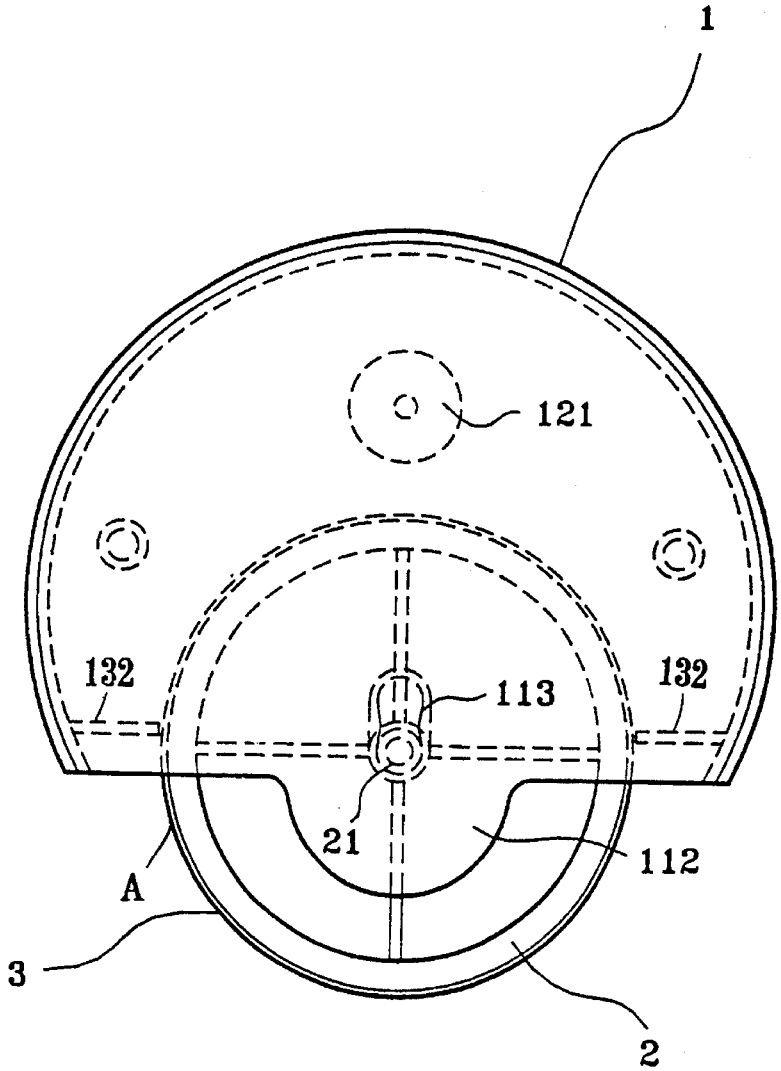
FIG. 2 is a plain view in section of the rotary stamp shown in FIG. 1.

Referring to FIGS. 1 and 2, a rotary stamp in accordance with the present invention is generally comprised of a casing 1, which consists of a right shell 11 and a left shell 12, an impression wheel 2, a belt stamp 3, and a cap 4. The right shell 11 and the left shell 12 are connected together by fitting respective male upright rods 121 on the left shell 12 into respective female upright rods 111 on the right shell 11. The right and left shells 11 and 12 have a respective flange 112 or 122 with a respective axle mounting hole 113 or 123. The impression wheel 2 has a wheel shaft 21 at the center projecting at two opposite sides and inserted into the axle mounting holes 113 and 123. Therefore, the impression wheel 2 can be turned between the right and left shells 11 and 12. The impression wheel 2 defines an annular groove 22 around the periphery. The belt stamp 3 is made from absorptive material, such as sponge, mounted around the annular groove 22 and having patterns formed on the outside surface for stamping on things. The casing 1 also provides end lateral flanges 132 which are disposed adjacent to but spaced away from the outside surface of the wheel 2 and the belt stamp 3 as they extend through the opening in the casing 1. When assembled, the impression wheel 2 is partially extended out of the casing 1 for stamping. The depth of the annular groove 22 is slightly less than the thickness of the belt stamp 3 such that the belt stamp 3 can be forcibly brought against an object 5 to mark it with the patterns. As the belt stamp 3 is mounted around the annular groove 22, it is protected from being excessively compressed. As the belt stamp 3 is made from absorptive material, it can be dipped in ink to absorb it before its installation.

Figure 3:
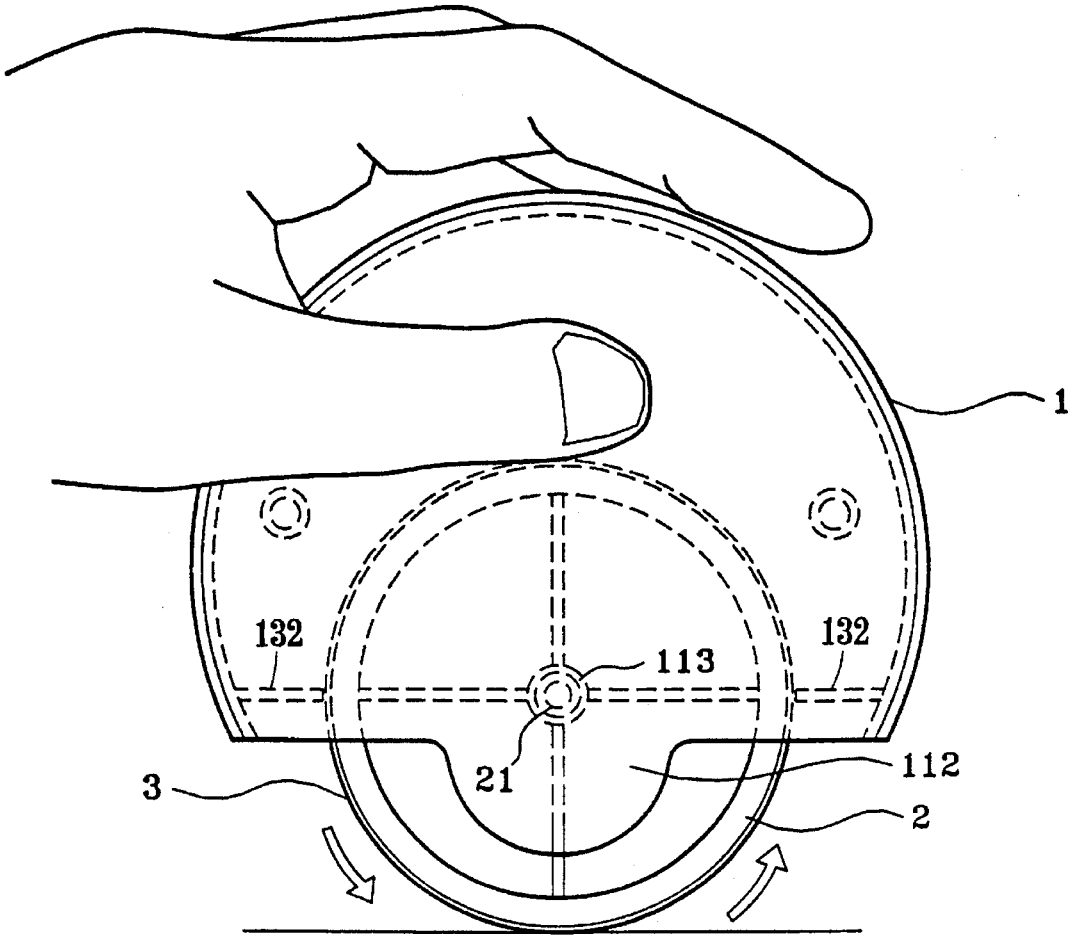
FIG. 3 is an applied view showing the rotary stamp of the present invention moved on an object to stamp it.
Figure 4:
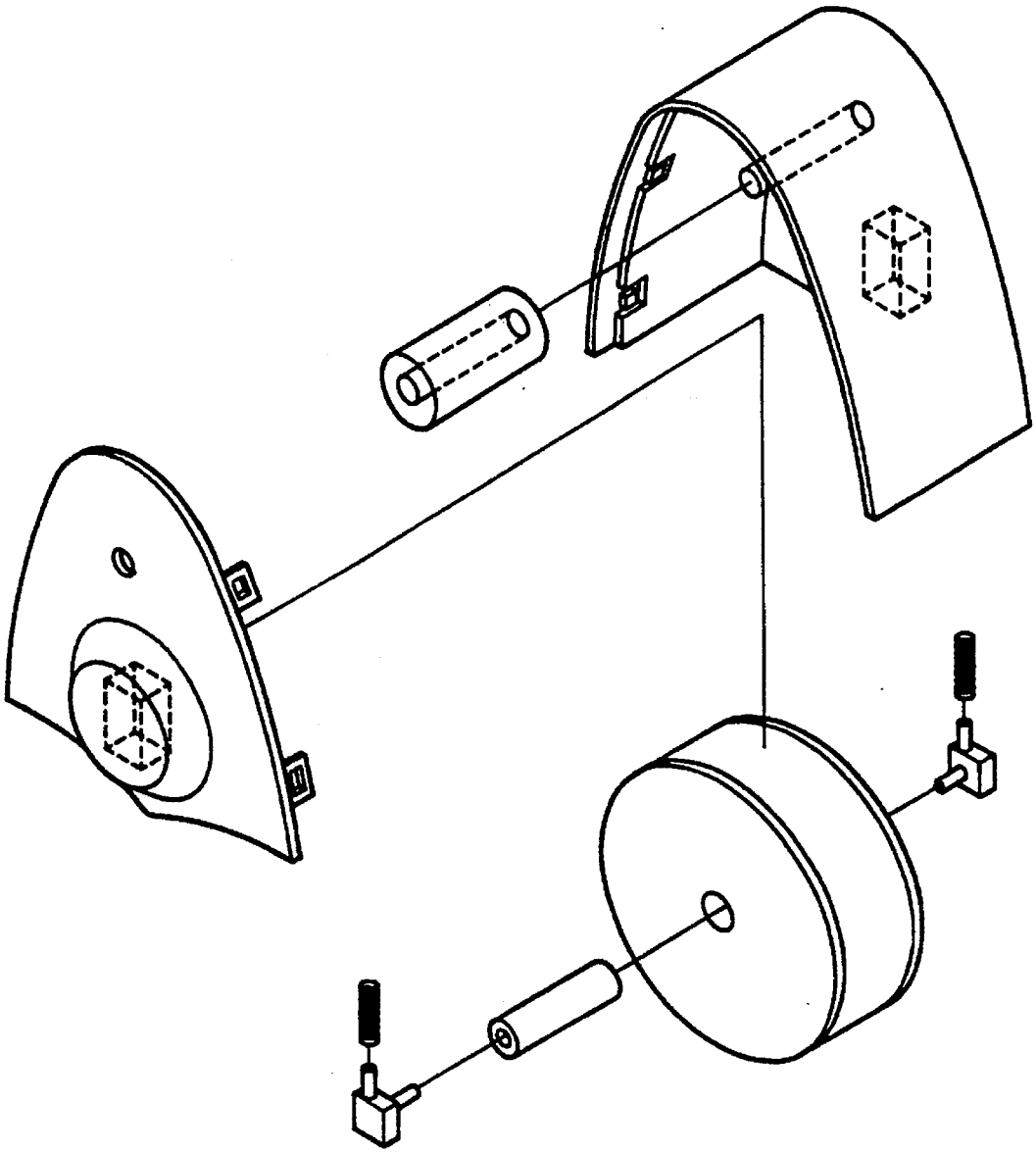
PRIOR ART Fig4
FIG. 4 is an exploded view of a rotary stamp according to the prior art.

Referring to FIG. 3, when the cap 4 is removed from the casing 1, the belt stamp 2 can be forced against the object 5 to be marked and turned to mark it. When not in use, the cap 4 is fastened to the casing 1 to protect the impression wheel 2 and the belt stamp 3 against dust.

What is claimed is:

1. A rotary stamp comprising:

a casing consisting of two shells connected together and defining an opening therebetween, each of said shells having a respective flange projecting out of said opening at either side thereof, said side flange of each shell forming an axle hole, said holes being in registration with each other, said casing further forming lateral end flanges extending between said shells at the opening;

an impression wheel connected between said shells and partially projecting through said opening, said impression wheel having an annular groove around its periphery of a predetermined depth and a wheel axle projecting out of two opposite sides thereof said axle projections being received in the respective axle hole on respective side flanges of said shells permitting said impression wheel to be turned between said shells, the peripheral surface of said wheel projecting through said opening being adjacent to but spaced away from said lateral end flanges; and an absorptive belt stamp mounted around said annular groove of said impression wheel, said absorptive belt stamp adapted to absorb ink and having a design on an outside surface thereof so that when said stamp is forcibly brought against an object and turned by said impression wheel it will mark said design on said object, the outside surface of said belt stamp being disposed adjacent to but spaced away from said lateral end flanges.

2. The rotary stamp of claim 1 wherein the depth of said annular groove is less than the thickness of said absorptive belt stamp.

3. The rotary stamp of claim 1 further comprising a cap member releasably affixed across the opening formed in said casing to enclose the wheel and belt stamp portions extending through the opening.

* * * * *